US006876336B2

(12) United States Patent
Croswell et al.

(10) Patent No.: US 6,876,336 B2
(45) Date of Patent: Apr. 5, 2005

(54) PHASED ARRAY ANTENNA WITH EDGE ELEMENTS AND ASSOCIATED METHODS

(75) Inventors: William F. Croswell, Melbourne, FL (US); Robert C. Taylor, Melbourne, FL (US); Anthony M. Jones, Palm Bay, FL (US); Timothy E. Durham, Palm Bay, FL (US)

(73) Assignee: Harris Corporation, Melbourne, FL (US)

( * ) Notice: Subject to any disclaimer, the term of this patent is extended or adjusted under 35 U.S.C. 154(b) by 65 days.

(21) Appl. No.: 10/633,930

(22) Filed: Aug. 4, 2003

(65) Prior Publication Data

US 2005/0030245 A1 Feb. 10, 2005

(51) Int. Cl.[7] ..... H01Q 1/38; H01Q 15/02

(52) U.S. Cl. ..... 343/795; 343/700 MS; 343/797; 343/802; 343/893; 343/813; 343/815; 343/824

(58) Field of Search ..... 343/795, 753, 343/700 MS, 797, 893, 754, 802, 824, 827, 812

(56) References Cited

U.S. PATENT DOCUMENTS 3,995,277 A 11/1976 Olyphant, Jr. ..... 343/846
4,180,817 A * 12/1979 Sanford ..... 343/700 MS
4,180,818 A * 12/1979 Schwartz et al. .... 343/700 MS
4,937,585 A * 6/1990 Shoemaker ..... 343/700 MS
5,132,699 A 7/1992 Rupp et al. ..... 343/880
5,801,660 A 9/1998 Ohtsuka et al. ..... 343/700 MS
6,198,460 B1 3/2001 Brankovic ..... 343/879
6,293,027 B1 9/2001 Elliott et al. ..... 33/546
6,417,813 B1 * 7/2002 Durham ..... 343/753
6,448,937 B1 9/2002 Aiken et al. ..... 343/817
6,512,487 B1 * 1/2003 Taylor et al. ..... 343/795
6,771,221 B2 * 8/2004 Rawnick et al. ..... 343/700 MS
6,822,616 B2 * 11/2004 Durham et al. ..... 343/795

* cited by examiner

*Primary Examiner*—Don Wong
*Assistant Examiner*—Chuc Tran
(74) *Attorney, Agent, or Firm*—Allen, Dyer, Doppelt, Milbrath & Gilchrist, P.A.

(57) ABSTRACT

A phased array antenna includes a substrate having a first surface, and a second surface adjacent thereto and defining an edge therebetween. A plurality of dipole antenna elements are on the first surface, and at least a portion of at least one dipole antenna element is on the second surface. Each dipole antenna element includes a medial feed portion and a pair of legs extending outwardly therefrom. Adjacent legs of adjacent dipole antenna elements on the first and second surfaces include respective spaced apart end portions having predetermined shapes and relative positioning for providing increased capacitive coupling between the adjacent dipole antenna elements.

38 Claims, 11 Drawing Sheets

PHASED ARRAY ANTENNA WITH EDGE ELEMENTS AND ASSOCIATED METHODS

FIELD OF THE INVENTION

The present invention relates to the field of communications, and more particularly, to phased array antennas.

BACKGROUND OF THE INVENTION

Existing microwave antennas include a wide variety of configurations for various applications, such as satellite reception, remote broadcasting, or military communication. The desirable characteristics of low cost, light weight, low profile and mass producibility are provided in general by printed circuit antennas. The simplest forms of printed circuit antennas are microstrip antennas wherein flat conductive elements, such as monopole or dipole antenna elements, are spaced from a single essentially continuous ground plane by a dielectric sheet of uniform thickness. An example of a microstrip antenna is disclosed in U.S. Pat. No. 3,995,277 to Olyphant.

The antennas are designed in an array and may be used for communication systems such as identification of friend/foe (IFF) systems, personal communication service (PCS) systems, satellite communication systems, and aerospace systems, which require such characteristics as low cost, light weight, low profile, and a low sidelobe. The bandwidth and directivity capabilities of such antennas, however, can be limiting for certain applications.

The use of electromagnetically coupled dipole antenna elements can increase bandwidth. Also, the use of an array of dipole antenna elements can improve directivity by providing a predetermined maximum scan angle.

However, utilizing an array of dipole antenna elements presents a dilemma. The maximum grating lobe free scan angle can be increased if the dipole antenna elements are spaced closer together, but a closer spacing can increase undesirable coupling between the elements, thereby degrading performance. This undesirable coupling changes rapidly as the frequency varies, making it difficult to maintain a wide bandwidth.

One approach for compensating the undesirable coupling between dipole antenna elements is disclosed in U.S. Pat. No. 6,417,813 to Durham, which is incorporated herein by reference in its entirety and which is assigned to the current assignee of the present invention. The Durham patent discloses a wideband phased array antenna comprising an array of dipole antenna elements, with each dipole antenna element comprising a medial feed portion and a pair of legs extending outwardly therefrom.

In particular, adjacent legs of adjacent dipole antenna elements include respective spaced apart end portions having predetermined shapes and relative positioning to provide increased capacitive coupling between the adjacent dipole antenna elements. The increased capacitive coupling counters the inherent inductance of the closely spaced dipole antenna elements, in such a manner as the frequency varies so that a wide bandwidth may be maintained.

The number of elements in an array of dipole antenna elements may range from several hundred to several thousand, with all of these elements being on the same substrate surface. To provide a uniform driving point impedance for the active dipole antenna elements along the edges of the array (i.e., the impedance for the elements along the edges is the same or very close to that of any element near the center of the array), dummy elements, which do not transmit or receive signals, are placed adjacent these elements.

However, design constraints for certain applications may limit the array size so that it has a significantly reduced number of active dipole antenna elements. For example, a small array of 50 elements with dummy dipole antenna elements along the edges thereof results in the percentage of dummy dipole antenna elements being large (>60%) as compared to the percentage of active dipole antenna elements (<40%) that actually transmit and receive signals. Consequently, performance of the phased array antenna is reduced, gain would be lower, and the beamwidth would be broader because of the area that is to be made available for the dummy dipole antenna elements on the same substrate as the active dipole antenna elements.

One approach for providing a uniform impedance for the active dipole antenna elements along the edges of the array while increasing performance is disclosed in U.S. Pat. No. 6,448,937 to Aiken et al. In Aiken et al., the dummy dipole antenna elements are fed separately from the active dipole antenna elements so that they are also able to transmit and receive signals. These separately fed elements also provide a uniform impedance for the active dipole antenna elements along the edges of the array. However, the additional feed lines for the dummy dipole antenna elements increase the complexity of the phased array antenna.

SUMMARY OF THE INVENTION

In view of the foregoing background, it is therefore an object of the present invention to provide a phased array antenna that makes better use of available surface area for an array of edge coupled dipole antenna elements.

This and other objects, features, and advantages in accordance with the present invention are provided by a phased array antenna comprising a substrate having a first surface, and a second surface adjacent thereto and defining an edge therebetween, and a plurality of dipole antenna elements on the first surface and at least a portion of at least one dipole antenna element on the second surface.

Each dipole antenna element may comprise a medial feed portion and a pair of legs extending outwardly therefrom, and adjacent legs of adjacent dipole antenna elements on the first and second surfaces include respective spaced apart end portions having predetermined shapes and relative positioning for providing increased capacitive coupling between the adjacent dipole antenna elements.

The phased array antenna may further comprise a ground plane adjacent the plurality of dipole antenna elements, with the at least one dipole antenna element having at least a portion thereof on the second surface being connected to the ground plane. A load, such as a resistive load, may also be connected to the medial feed portion of this dipole antenna element so that it operates as a dummy dipole antenna element. The resistive load may include a printed resistive element or a discrete resistor, for example.

The phased array antenna in accordance with the present invention is particularly advantageous when design constraints limit the number of active dipole antenna elements in the array. The design constraints may be driven by a platform having limited installation space, and one which also requires a low radar cross section (RCS). Normally, active and passive dipole antenna elements are on the same substrate surface. However, by separating the active and passive dipole antenna elements onto two different substrate surfaces having respective edges defined therebetween, more space is available for the active dipole antenna elements. Consequently, antenna performance is improved for phased array antennas affected by design constraints.

In one embodiment, the substrate has a generally rectangular shape having a top surface defining the first surface, and first and second pairs of opposing side surfaces defining the second surface.

Each leg of a dipole antenna element may comprise an elongated body portion, and an enlarged width end portion connected to an end of the elongated body portion. In addition, the spaced apart end portions in adjacent legs may comprise interdigitated portions, wherein each leg may comprise an elongated body portion, an enlarged width end portion connected to an end of the elongated body portion, and a plurality of fingers extending outwardly from the enlarged width end portion.

The phased array antenna has a desired frequency range and the spacing between the end portions of adjacent legs may be less than about one-half a wavelength of a highest desired frequency. In addition, the ground plane may be spaced from the plurality of dipole antenna elements less than about one-half a wavelength of a highest desired frequency.

Also, the plurality of dipole antenna elements may comprise first and second sets of orthogonal dipole antenna elements to provide dual polarization. The plurality of dipole antenna elements may be sized and relatively positioned so that the phased array antenna is operable over a frequency range of about 2 to 30 GHz, and over a scan angle of about +/−60 degrees.

To further increase the capacitive coupling between adjacent legs of adjacent dipole antenna elements, a respective impedance element may be electrically connected between the spaced apart end portions of adjacent legs of adjacent dipole antenna elements. In other embodiments, a respective printed impedance element may be positioned adjacent the spaced apart end portions of adjacent legs of adjacent dipole antenna elements for further increasing the increased capacitive coupling therebetween.

Another aspect of the present invention is directed to a method of making a phased array antenna on a substrate having a first surface, and a second surface adjacent thereto and defining an edge therebetween. The method comprises forming a plurality of dipole antenna elements on the first surface and at least a portion of at least one dipole antenna element on the second surface. Each dipole antenna element may comprise a medial feed portion and a pair of legs extending outwardly therefrom, and adjacent legs of adjacent dipole antenna elements on the first and second surfaces include respective spaced apart end portions having predetermined shapes and relative positioning for providing increased capacitive coupling between the adjacent dipole antenna elements.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime, double prime and triple prime notations are used to indicate similar elements in alternate embodiments.

Figure 1:
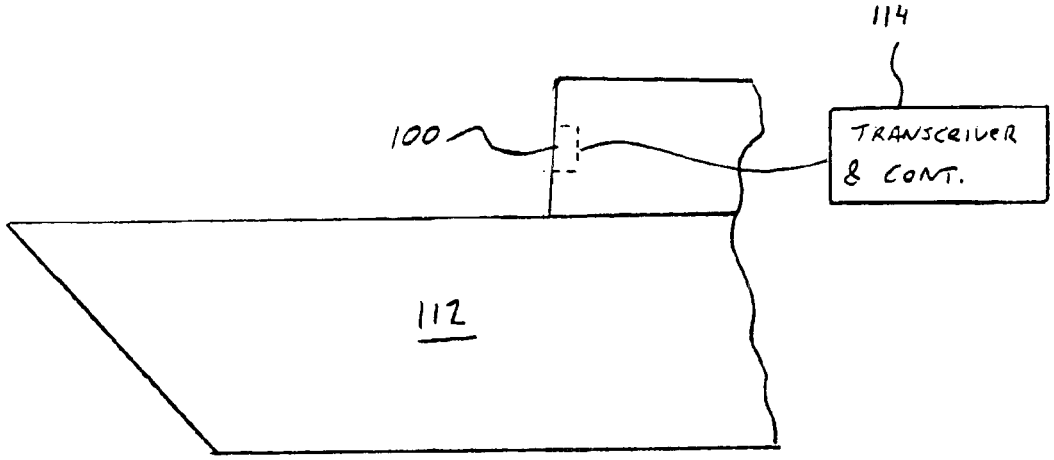
FIG. 1 is a schematic diagram of a phased array antenna in accordance with the present invention mounted on a ship.
Figure 2:
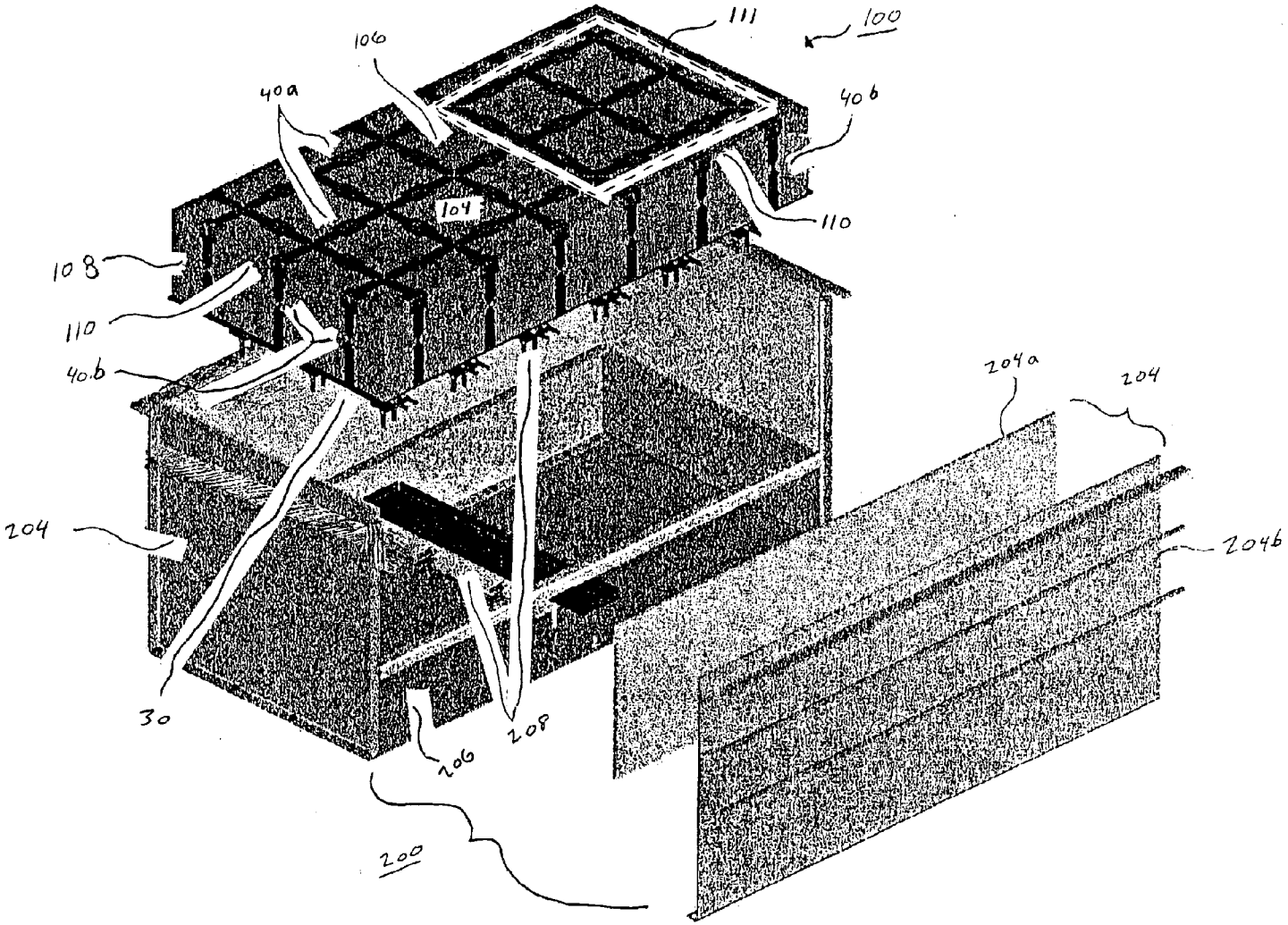
FIG. 2 is a schematic perspective view of the phased array antenna of FIG. 1 and a corresponding cavity mount.

Referring initially to FIGS. 1 and 2, a wideband phased array antenna 100 in accordance with the present invention will now be described. The phased array antenna 100 is particularly advantageous when design constraints limit the number of active dipole antenna elements in the array. The design constraints may be driven by a platform having limited installation space, and one which also requires a low radar cross section (RCS), such as the ship 112 illustrated in FIG. 1, for example. The illustrated phased array antenna 110 is connected to a transceiver and controller 114, as would be appreciated by those skilled in the art.

The phased array antenna 100 has edge elements 40*b*, and a corresponding cavity mount 200, as illustrated by the schematic perspective view in FIG. 2. The phased array antenna 100 comprises a substrate 104 having a first surface 106, and second surfaces 108 adjacent thereto and defining respective edges 110 therebetween. A plurality of dipole antenna elements 40*a* are on the first surface 106 and at least a portion of at least one dipole antenna element 40*b* is on one of the second surfaces 108. The dipole antenna elements 40*b* on the second surfaces 108 form the "edge elements" for the phased array antenna 100.

Normally, active and passive dipole antenna elements are on the same substrate surface. However, by separating the active and passive dipole antenna elements 40*a*, 40*b* onto two different substrate surfaces 106, 108 having respective edges 110 defined therebetween, more space is available for the active dipole antenna elements. Consequently, antenna performance is improved for phased array antennas affected by design constraints.

In the illustrated embodiment, the second surfaces 108 are orthogonal to the first surface 106. The substrate 104 has a generally rectangular shape having a top surface, and first and second pairs of opposing side surfaces adjacent the top surface and defining the respective edges 110 therebetween. The first surface 106 corresponds to the top surface, and the second surfaces 108 correspond to the first and second pairs of opposing side surfaces. The illustrated edge elements 40*b* are on each of the pairs of opposing side surfaces. In different embodiments, the edge elements 40*b* may be on just one of the pairs of opposing side surfaces, or even just one side surface. In addition, the substrate 104 is not limited to a rectangular shape, and is not limited to orthogonal side surfaces with respect to the top surface.

The edge elements 40*b*, that is, the dipole antenna elements on the second surfaces 108, may be completely formed on the second surfaces, or they may be formed so that part of these elements extend onto the first surface 106. For the later embodiment, the substrate 104 may be a monolithic flexible substrate, and the second surfaces are formed by simply bending the substrate so that one of the legs of the edge elements 40*b* extends onto the first surface 106. Alternatively, at least one of the legs of the dipole antenna elements 40*a* on the first surface 106 may extend onto the second surface 108.

The bend also defines the respective edges 110 between the first and second surfaces 106, 108. In lieu of a monolithic substrate, the first and second surfaces 106, 108 may be separately formed (with the respective dipole antenna elements 40*a*, 40*b* being formed completely on the respective surfaces 106, 108), and then joined together to form the substrate 104, as would be readily appreciated by those skilled in the art.

The illustrated phased array antenna 100 includes first and second sets of orthogonal dipole antenna elements to provide dual polarization. In alternate embodiments, the phased array antenna 100 may include only one set of dipole antenna elements.

Figure 3:
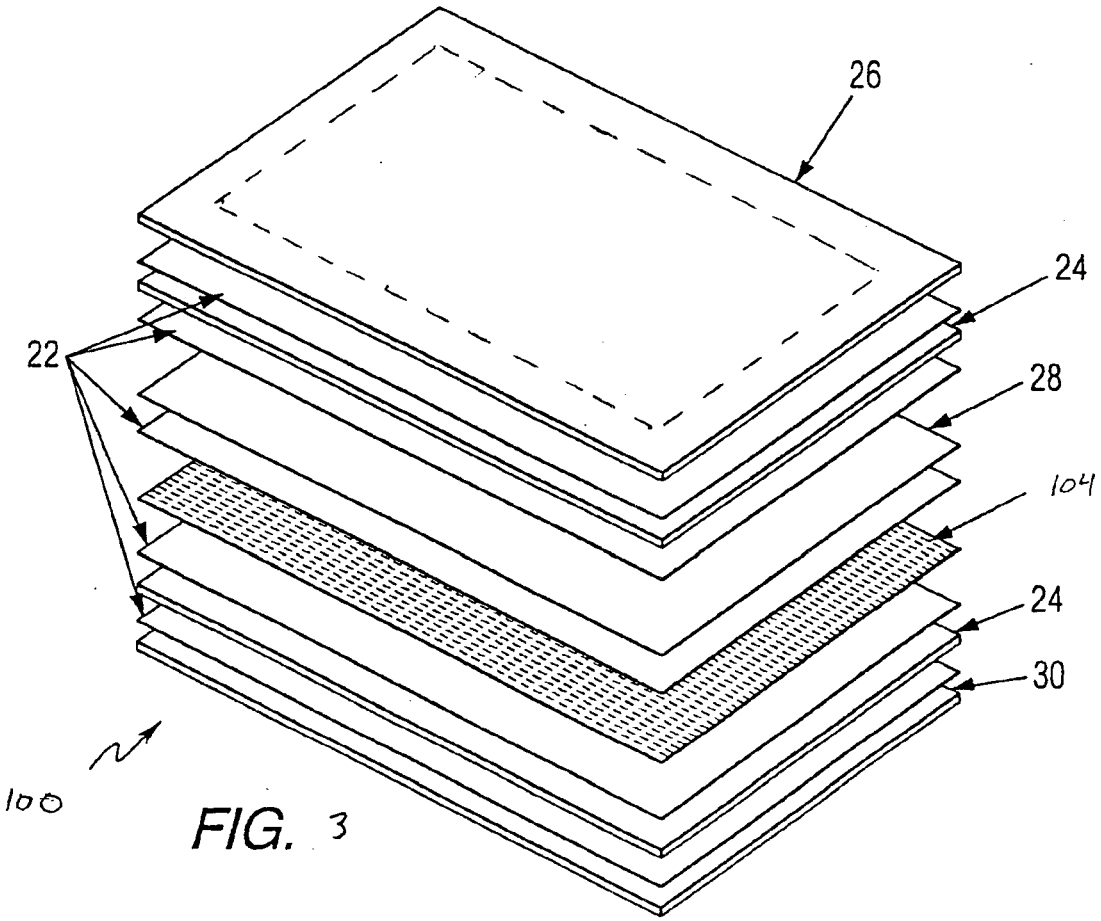
FIG. 3 is an exploded view of the phased array antenna of FIG. 2.

The phased array antenna 100 is formed of a plurality of flexible layers, as shown in FIG. 3. As discussed above, the substrate 104, which is included within the plurality of flexible layers, may be a monolithic flexible substrate, and the second surfaces 108 are formed by simply bending the layers along the illustrated dashed line, for example. Excess material in the corners of the folded layers resulting from the second surfaces 108 being formed are removed, as would be appreciated by those skilled in the art.

The substrate 104 is sandwiched between a ground plane 30 and a cap layer 28. The substrate 104 is also known as a dipole layer or a current sheet, as would be readily understood by those skilled in the art. Additionally, dielectric layers of foam 24 and an outer dielectric layer of foam 26 are provided. Respective adhesive layers 22 secure the substrate 104, ground plane 30, cap layer 28, and dielectric layers of foam 24, 26 together to form the phased array antenna 100. Of course, other ways of securing the layers may also be used as would be appreciated by those skilled in the art.

The dielectric layers 24, 26 may have tapered dielectric constants to improve the scan angle. For example, the dielectric layer 24 between the ground plane 30 and the dipole layer 20 may have a dielectric constant of 3.0, the dielectric layer 24 on the opposite side of the dipole layer 20 may have a dielectric constant of 1.7, and the outer dielectric layer 26 may have a dielectric constant of 1.2.

Figure 4:
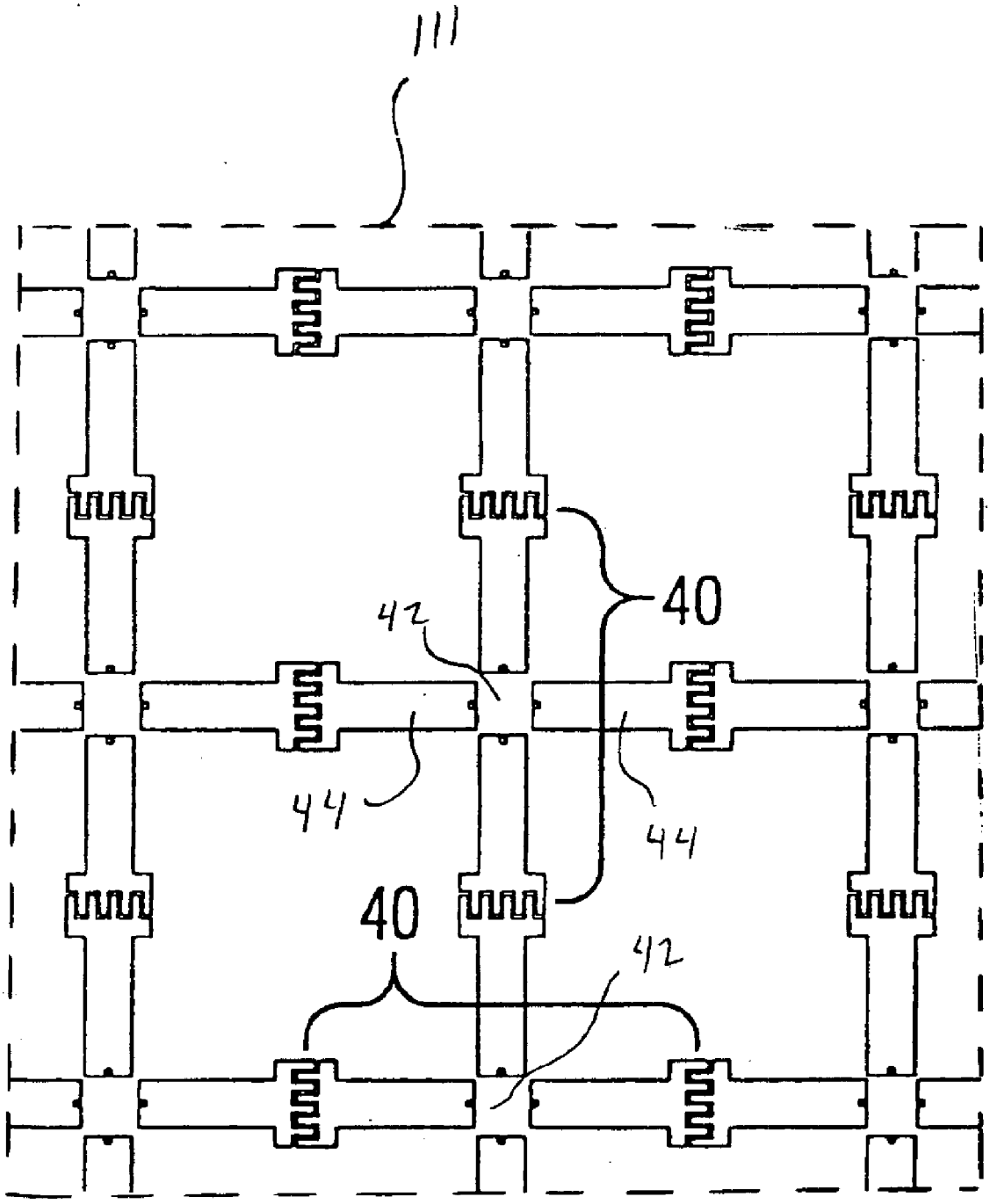
FIG. 4 is a greatly enlarged view of a portion of the array of FIG. 2.
Figure 5A:
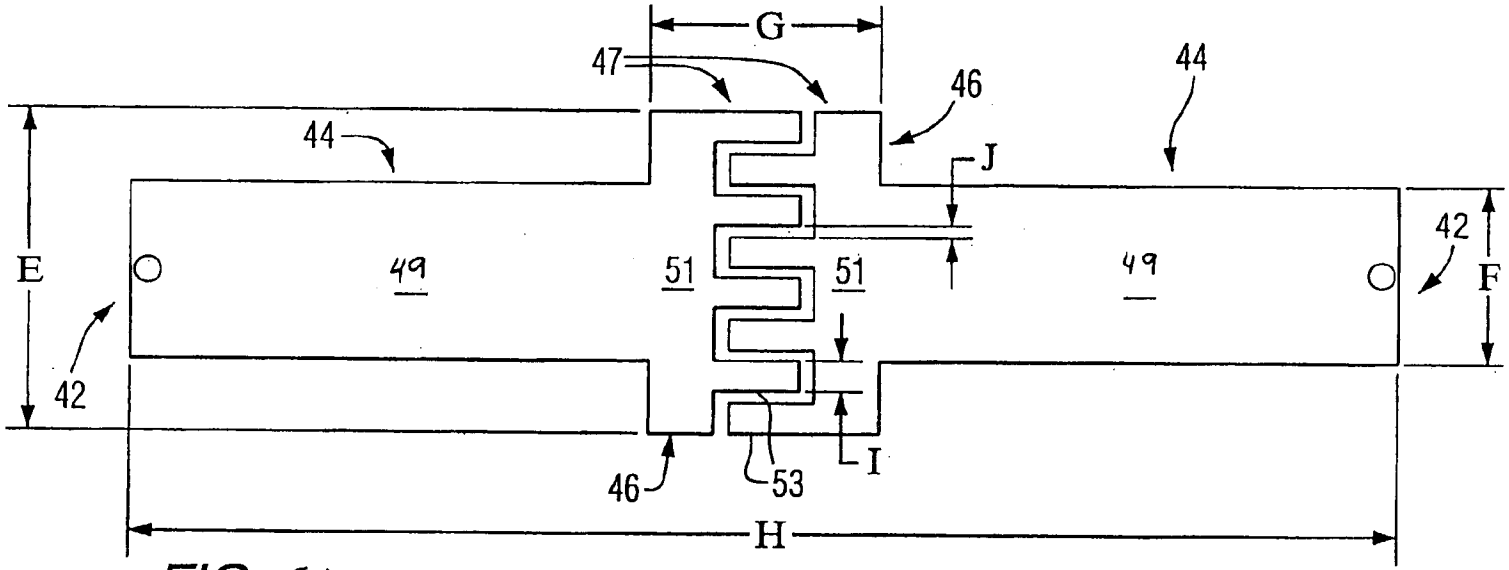
FIGS. 5A and 5B are enlarged schematic views of the spaced apart end portions of adjacent legs of adjacent dipole antenna elements as may be used in the phased array antenna of FIG. 2.
Figure 5B:
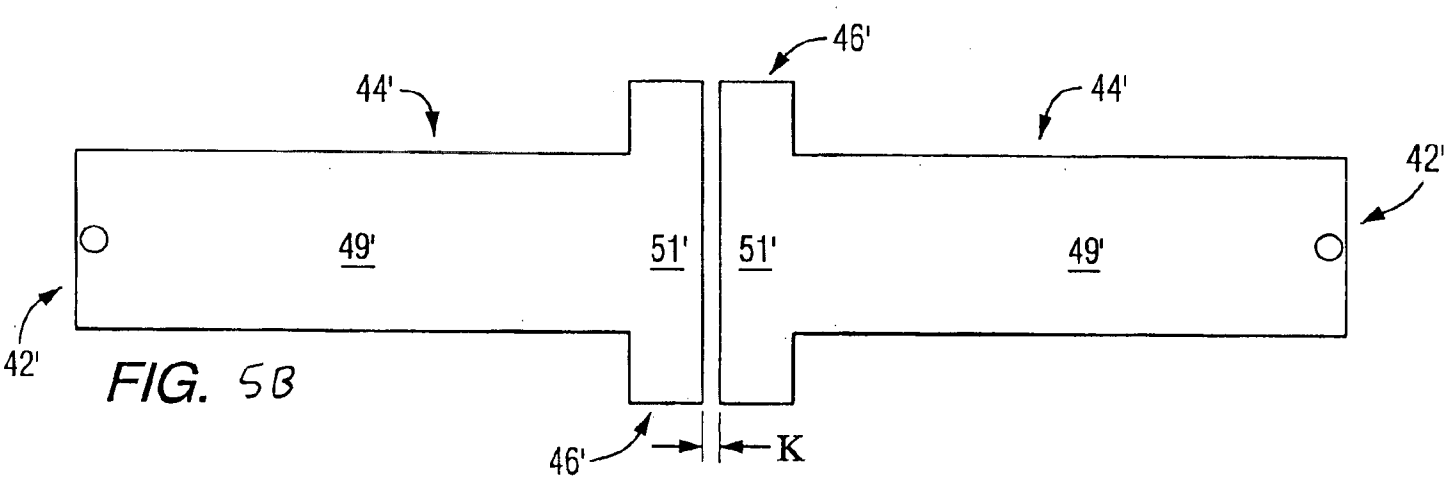

Referring now to FIGS. 4, 5A and 5B, the substrate 104 as used in the phased array antenna 100 will now be described in greater detail. The substrate 104 is a printed conductive layer having an array of dipole antenna elements 40 thereon, as shown in greater detail in the enlarged view of a portion 111 of the substrate 104. Each dipole antenna element 40 comprises a medial feed portion 42 and a pair of legs 44 extending outwardly therefrom. Respective feed lines would be connected to each feed portion 42 from the opposite side of the substrate 104.

Adjacent legs 44 of adjacent dipole antenna elements 40 have respective spaced apart end portions 46 to provide increased capacitive coupling between the adjacent dipole antenna elements. The adjacent dipole antenna elements 40 have predetermined shapes and relative positioning to provide the increased capacitive coupling. For example, the capacitance between adjacent dipole antenna elements 40 is between about 0.016 and 0.636 picofarads (pF), and preferably between 0.159 and 0.239 pF. Of course, these values will vary as required depending on the actual application to achieve the same desired bandwidth, as readily understood by one skilled in the art.

As shown in FIG. 5A, the spaced apart end portions 46 in adjacent legs 44 may have overlapping or interdigitated portions 47, and each leg 44 comprises an elongated body portion 49, an enlarged width end portion 51 connected to an end of the elongated body portion, and a plurality of fingers 53, e.g., four, extending outwardly from the enlarged width end portion.

The adjacent legs 44 and respective spaced apart end portions 46 may have the following dimensions: the length E of the enlarged width end portion 51 equals 0.061 inches; the width F of the elongated body portions 49 equals 0.034 inches; the combined width G of adjacent enlarged width end portions 51 equals 0.044 inches; the combined length H of the adjacent legs 44 equals 0.276 inches; the width I of each of the plurality of fingers 53 equals 0.005 inches; and the spacing J between adjacent fingers 53 equals 0.003 inches.

The wideband phased array antenna 10 has a desired frequency range, e.g., 2 GHz to 30 GHz, and the spacing between the end portions 46 of adjacent legs 44 is less than about one-half a wavelength of a highest desired frequency. Depending on the actual application, the desired frequency may be a portion of this range, such as 2 GHz to 18 GHz, for example.

Alternatively, as shown in FIG. 5B, adjacent legs 44' of adjacent dipole antenna elements 40 may have respective spaced apart end portions 46' to provide increased capacitive coupling between the adjacent dipole antenna elements. In this embodiment, the spaced apart end portions 46' in adjacent legs 44' comprise enlarged width end portions 51' connected to an end of the elongated body portion 49' to provide the increased capacitive coupling between adjacent dipole antenna elements 40. Here, for example, the distance K between the spaced apart end portions 46' is about 0.003 inches.

Figure 5C:
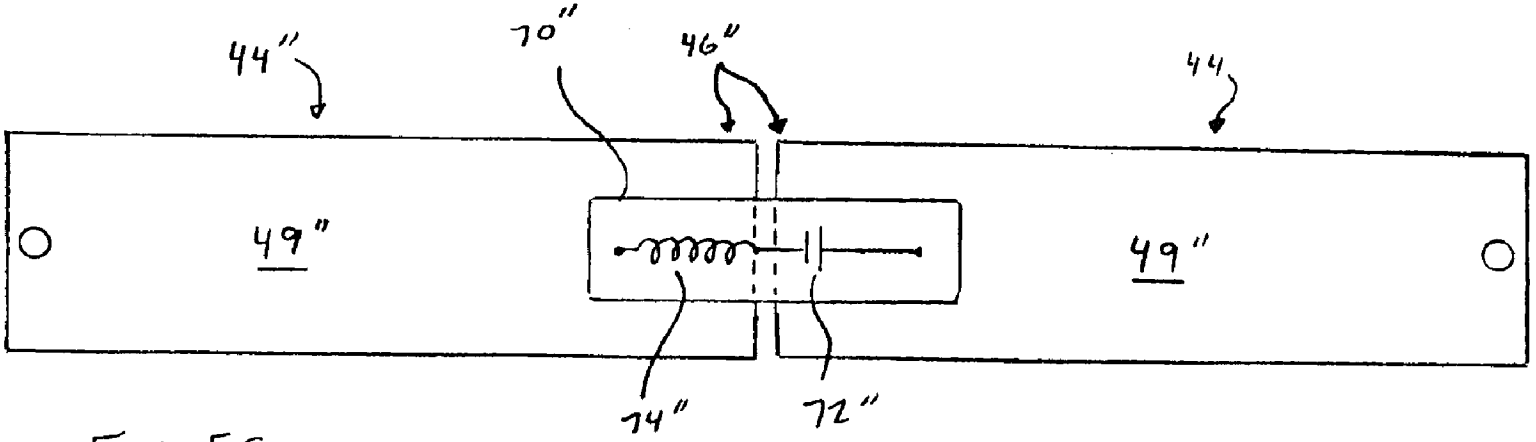
FIG. 5C is an enlarged schematic view of an impedance element electrically connected across the spaced apart end portions of adjacent legs of adjacent dipole antenna elements as may be used in the wideband phased array antenna of FIG. 2.

To further increase the capacitive coupling between adjacent dipole antenna elements 40, a respective discrete or bulk impedance element 70" is electrically connected across the spaced apart end portions 46" of adjacent legs 44" of adjacent dipole antenna elements, as illustrated in FIG. 5C.

In the illustrated embodiment, the spaced apart end portions 46" have the same width as the elongated body portions 49". The discrete impedance elements 70" are preferably soldered in place after the dipole antenna elements 40 have been formed so that they overlay the respective adjacent legs 44" of adjacent dipole antenna elements 40. This advantageously allows the same capacitance to be provided in a smaller area, which helps to lower the operating frequency of the wideband phased array antenna 10.

The illustrated discrete impedance element 70" includes a capacitor 72" and an inductor 74" connected together in series. However, other configurations of the capacitor 72" and inductor 74" are possible, as would be readily appreciated by those skilled in the art. For example, the capacitor 72" and inductor 74" may be connected together in parallel, or the discrete impedance element 70" may include the capacitor without the inductor or the inductor without the capacitor. Depending on the intended application, the discrete impedance element 70" may even include a resistor.

The discrete impedance element 70" may also be connected between the adjacent legs 44 with the overlapping or interdigitated portions 47 illustrated in FIG. 5A. In this configuration, the discrete impedance element 70" advantageously provides a lower cross polarization in the antenna patterns by eliminating asymmetric currents which flow in the interdigitated capacitor portions 47. Likewise, the discrete impedance element 70" may also be connected between the adjacent legs 44' with the enlarged width end portions 51' illustrated in FIG. 5B.

Another advantage of the respective discrete impedance elements 70" is that they may have different impedance values so that the bandwidth of the wideband phased array antenna 10 can be tuned for different applications, as would be readily appreciated by those skilled in the art. In addition, the impedance is not dependent on the impedance properties of the adjacent dielectric layers 24 and adhesives 22. Since the discrete impedance elements 70" are not effected by the dielectric layers 24, this approach advantageously allows the impedance between the dielectric layers 24 and the impedance of the discrete impedance element 70" to be decoupled from one another.

Figure 5D:
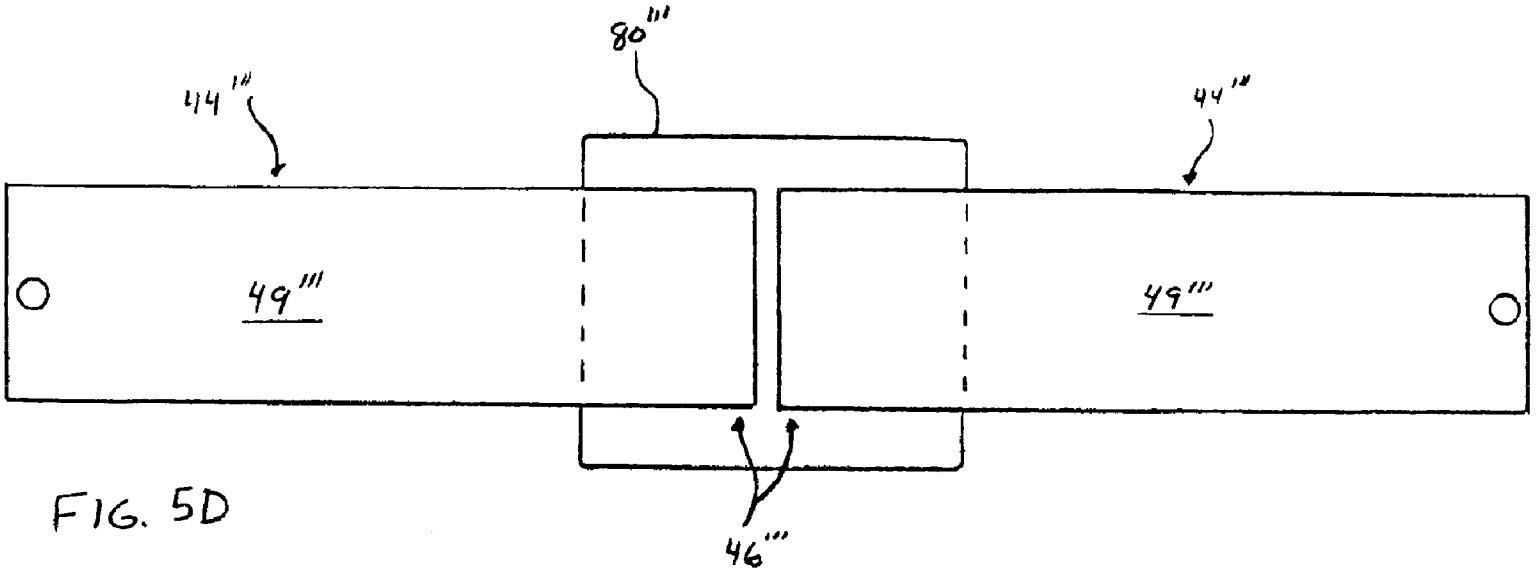
FIG. 5D is an enlarged schematic view of another embodiment of an impedance element electrically connected across the spaced apart end portions of adjacent legs of adjacent dipole antenna elements as may be used in the wideband phased array antenna of FIG. 2.

Yet another approach to further increase the capacitive coupling between adjacent dipole antenna elements 40 includes placing a respective printed impedance element 80'" adjacent the spaced apart end portions 46'" of adjacent legs 44'" of adjacent dipole antenna elements 40, as illustrated in FIG. 5D.

The respective printed impedance elements 80'" are separated from the adjacent legs 44'" by a dielectric layer, and are preferably formed before the dipole antenna layer 20 is formed so that they underlie the adjacent legs 44'" of the adjacent dipole antenna elements 40. Alternatively, the respective printed impedance elements 80'" may be formed after the dipole antenna layer 20 has been formed. For a more detailed explanation of the printed impedance elements, reference is directed to U.S. patent application Ser. No. 10/308,424 which is assigned to the current assignee of the present invention, and which is incorporated herein by reference.

Figure 6A:
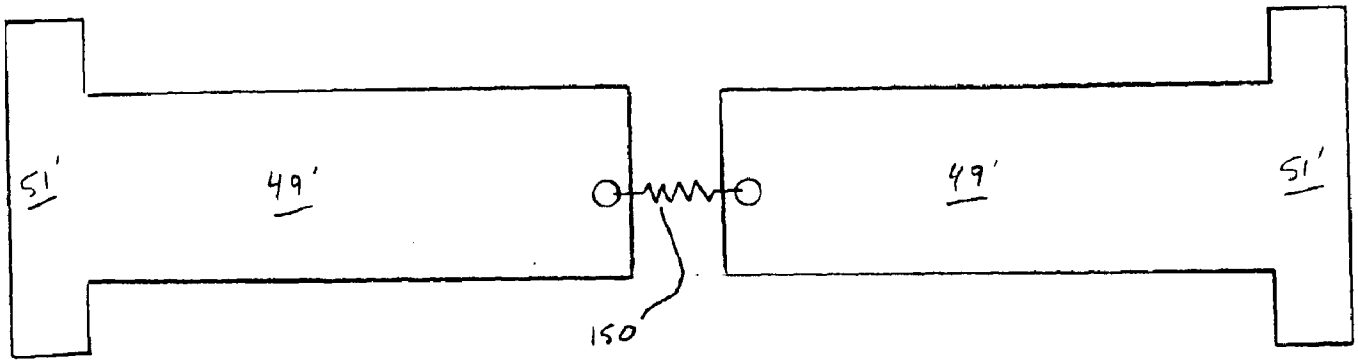
FIGS. 6A and 6B are enlarged schematic views of a discrete resistive element and a printed resistive element connected across the medial feed portion of a dipole antenna element as may be used in the phased array antenna of FIG. 2.
Figure 6B:
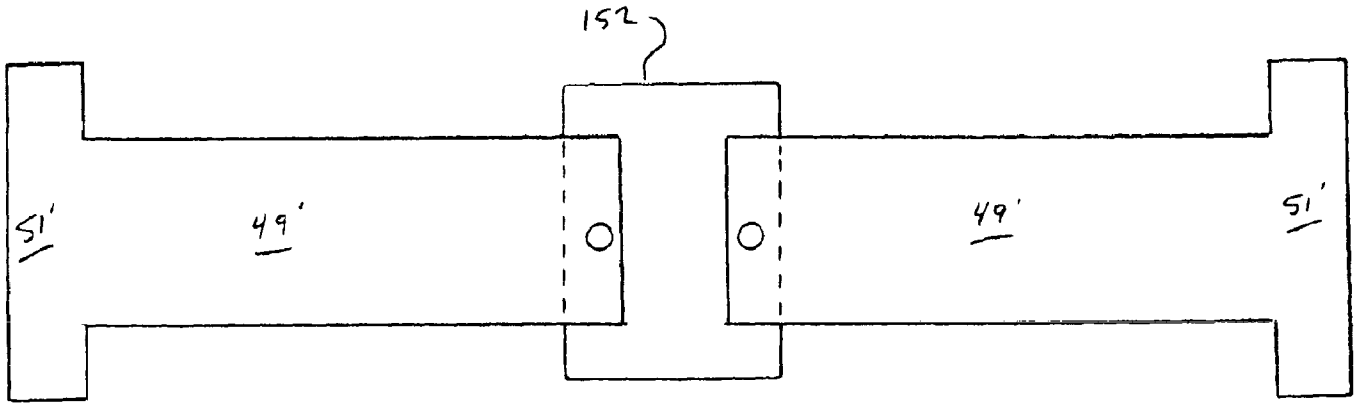

A respective load 150 is preferably connected to the medial feed portions 42 of the dipole antenna elements **40*d* on the second surfaces 108 so that they will operate as dummy dipole antenna elements. The load 150 may include a discrete resistor, as illustrated in FIG. 6A, or a printed resistive element 152, as illustrated in FIG. 6B. Each discrete resistor 150 is soldered in place after the dipole antenna elements 40*d* have been formed. Alternatively, each discrete resistor 150 may be formed by depositing a resistive paste on the medial feed portions 42, as would be readily appreciated by those skilled in the art. The respective printed resistive elements 152 may be printed before, during or after formation of the dipole antenna elements 40*d*, as would also be readily appreciated by those skilled in the art. The resistance of the load 150** is typically selected to match the impedance of a feed line connected to an active dipole antenna element, which is in a range of about 50 to 100 ohms.

A ground plane 30 is adjacent the plurality of dipole antenna elements **40*a*, 40*b*, and to further improve performance of the phased array antenna 100, the edge elements 40*b* are electrically connected to the ground plane. The ground plane 30 is preferably spaced from the first surface 106 of the substrate 104** less than about one-half a wavelength of a highest desired frequency.

Figure 7A:
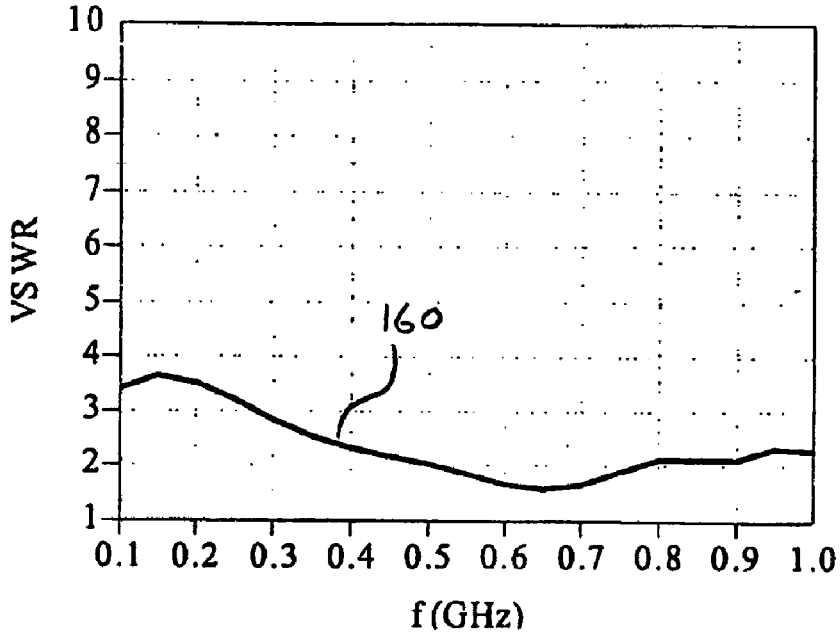
FIGS. 7A and 7B are plots of computed VSWR versus frequency for an active dipole antenna element adjacent the edge elements in the phased array antenna of FIG. 2, and for the same active dipole antenna element without the edge elements in place.
Figure 7B:
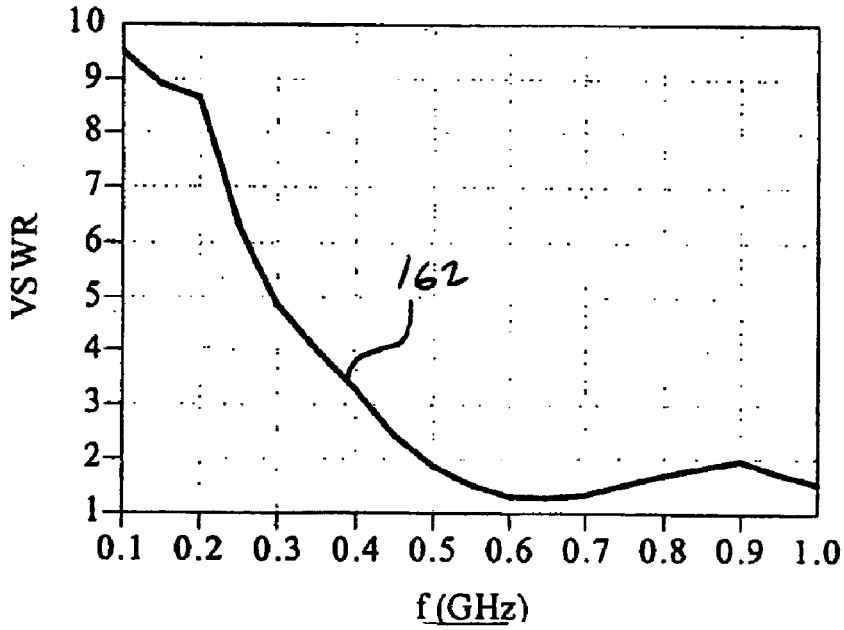

For an array of 18 active dipole antenna elements on the first surface 106 of the substrate 104, FIG. 7A is a plot of computed VSWR versus frequency for the active dipole antenna element immediately adjacent the edge elements **40*b*, and FIG. 7B is also a plot of computed VSWR versus frequency for the same active dipole antenna element except without the edge elements in place. Line 160 illustrates that there is advantageously a low VSWR between 0.10 and 0.50 GHz with the edge elements 40*b* in place. The edge elements 40*b* allow the immediately adjacent active dipole antenna elements to receive sufficient current, which is normally conducted through the dipole antenna elements 40*a*, 40*b* on the substrate 104**.

Figure 8A:
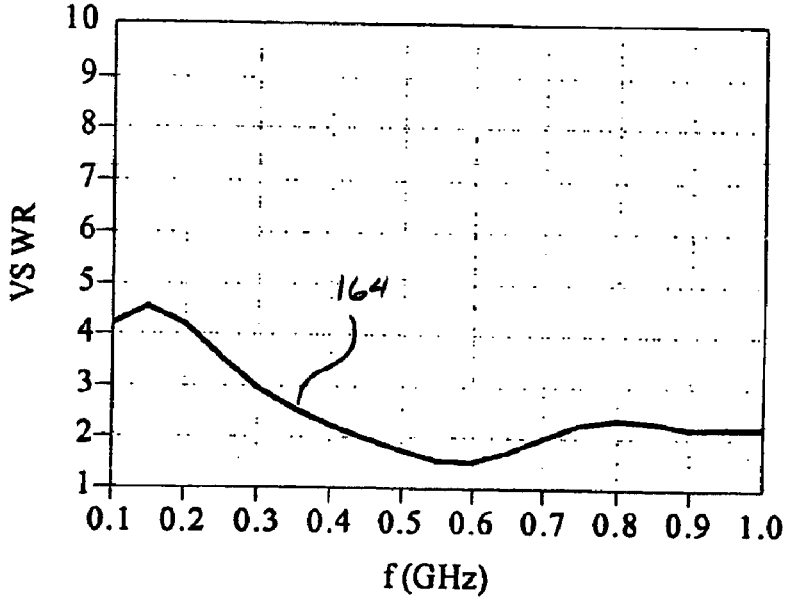
FIGS. 8A and 8B are plots of computed VSWR versus frequency for an active dipole antenna element in the center of the phased array antenna of FIG. 2 with the edge elements in place, and for the same dipole antenna element without the edge elements in place.
Figure 8B:
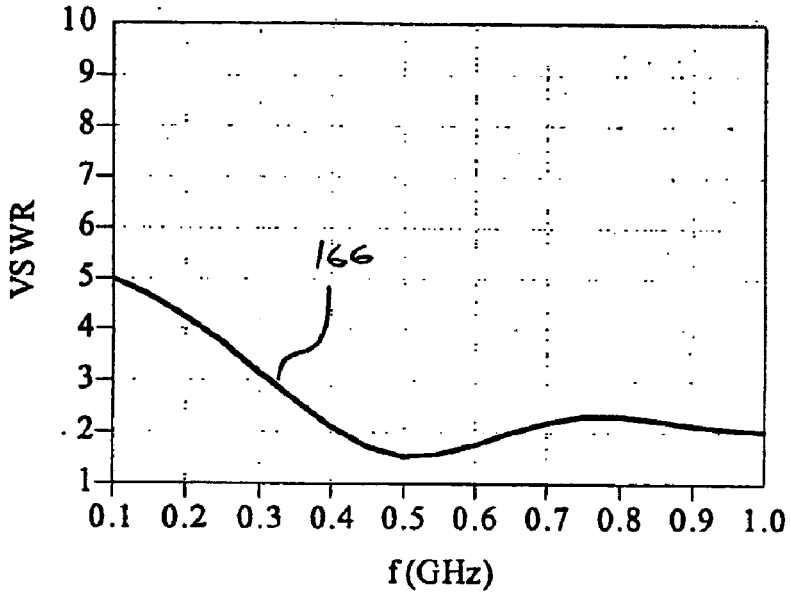

Referring now to FIGS. 8A and 8B, the VSWR versus frequency remains fairly the same between the two configurations (i.e., with and without the edge elements **40*b* in place) with respect to the active dipole antenna elements 40*a* in or near the center of the first surface 106. Line 164 illustrates the computed VSWR for an active dipole antenna element with the edge elements 40*b* in place, and line 166** illustrates the computed VSWR for the same active dipole antenna element without the dummy elements in place.

In the illustrated phased array antenna 100, there are 18 dipole antenna elements **40*a* on the first surface 106 and 18 dipole antenna elements 40*b* on the second surfaces 108. Even though the number of dipole antenna elements for this type of phased array antenna 100 is not limited to any certain number of elements, it is particularly advantageous when the number of elements is such that the percentage of edge elements 40*b* on the second surfaces 108 is large when compared to the percentage of active dipole antenna elements 40*a* on the first surface 106. Performance of the phased array antenna 100 is improved because the active elements 40*a* extend to the edges 110 of the first surface 106 of the substrate 104**.

The corresponding cavity mount 200 for the phased array antenna 100 with edge elements **40*d* will now be discussed in greater detail. The cavity mount 200 is a box having an opening therein for receiving the phased array antenna 100, and comprises a signal absorbing surface 204 adjacent each second surface 108 of the substrate 104 having edge elements 40*b*** thereon.

As discussed above, the dipole antenna elements 40*b* on the second surfaces 108 are dummy elements. Even though the dummy elements 40*b* are not connected to a feed line, they still receive signals at the respective loads 150 connected across the medial feed portions 42. To prevent these signals form being reflected within the cavity mount 200, the signal absorbing surfaces 204 are placed adjacent the dummy elements 40*b*.

Without the signal absorbing surfaces 204 in place, the reflected signals would create electromagnetic interference (EMI) problems, and they may also interfere with the adjacent active dipole antenna elements 40*a* on the first surface 106 of the substrate 104. The signal absorbing surfaces 204 thus absorb reflected signals so that the dipole antenna elements 40*a* on the first surface 106 appear as if they are in a free space environment.

Each signal absorbing surface 204 comprises a ferrite material layer 204*a* and a conducting layer 204*b* adjacent thereto. The conducting layer 204*b*, such as a metal layer, prevents any RF signals from radiating external the cavity mount 200. Instead of a ferrite material layer, another type of RF absorbing material layer may be used, as would be readily appreciated by one skilled in the art.

In alternate embodiments, the signal absorbing surfaces 204 include a resistive layer and a conductive layer thereto. The resistive layer is coated on the conductive layer so that the conductive layer functions as a signal absorbing surface. The embodiment of the signal absorbing surfaces does not include the ferrite material layer 204*a*, which reduces the weight of the cavity mount 200. In yet another alternate embodiment, the signal absorbing surfaces 204 includes just the conductive layer.

When the phased array antenna 100 is positioned within the cavity mount 200, the first surface 106 of the substrate 104 is substantially coplanar with an upper surface of the cavity mount. The height of the ferrite material layer 204*a* is preferably at least equal to a height of the second surface 108 of the substrate 104. In addition, the cavity mount 200 also carries a plurality of power dividers 208 for interfacing with the dipole antenna elements 40*a* on the first surface 106 of the substrate 104. When the second surface 108 is orthogonal to the first surface 106 of the substrate 104, the cavity mount 200 has a bottom surface 206 that is also orthogonal to the signal absorbing surfaces 204.

Figure 9:
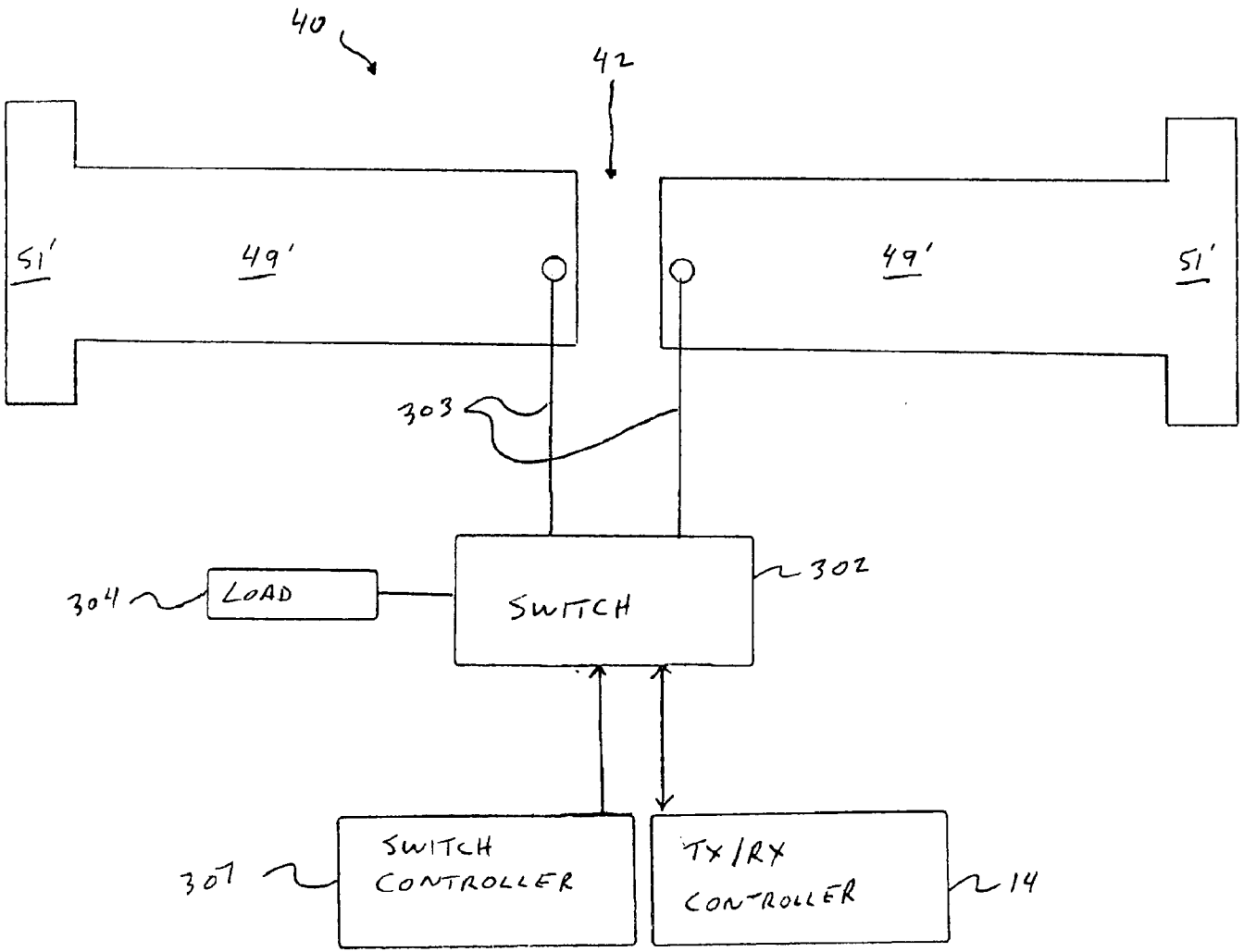
FIG. 9 is a schematic diagram of a dipole antenna element having a switch and a load connected thereto so that the element selectively functions as an absorber in accordance with the present invention.

Yet another aspect of the present invention is directed to a phased array antenna 300 that selectively functions as an absorber. In particular, each dipole antenna element 40 has a switch 302 connected to its medial feed portion 42 via feed lines 303, and a passive load 304 is connected to the switch, as illustrated in FIG. 9. The switch 302, in response to a control signal generated by a switch controller 307, selectively couples the passive load 304 to the medial feed portion 42 so that the dipole antenna element 40 selectively functions as an absorber for absorbing received signals.

The passive load 304 is sized to dissipate the energy associated with the received signal, and may comprise a printed resistive element or a discrete resistor, as would be readily appreciated by those skilled in the art. For example, the resistance of the passive load 304 is typically between 50 to 100 ohms to match the impedance of the feed lines 303 when the dipole antenna element 40 passes along the received signals for processing.

As the frequency range decreases from the GHz range to the MHz range, the size of the phased array antenna significantly increases. This presents concerns when a low radar cross section (RCS) mode is required, and also in terms of deployment because of the increased size of the phased array antenna.

With respect to the RCS concerns, the respective switches 302 and passive loads 304 allow the phased array antenna 300 to operate as an absorber. For example, if a ship or any other type platform (fixed or mobile) deploying the phased array antenna 300 intends to maintain a low RCS, then the elements are selectively coupled to their respective passive loads 304 for dissipating the energy associated with any received signals. When communications is required, the respective switches 306 uncouple the passive loads 304 so that the signals are passed along to the transmission and reception controller 14.

Each phased array antenna has a desired frequency range, and the ground plane 310 is typically spaced from the array of dipole antenna elements 40 less than about one-half a wavelength of a highest desired frequency. In addition, the dipole antenna elements 40 may also be spaced apart from one another less than about one-half a wavelength of the highest desired frequency.

When the frequency is in the GHz range, the separation between the array of dipole antenna elements 40 and the ground plane 310 is less than 0.20 inch at 30 GHz, for example. This does not necessarily present a problem in terms of RCS and deployment. However, when the frequency of operation of the phased array antenna 300 is in the MHz range, the separation between the array of dipole antenna elements 40 and the ground plane 310 increases to about 19 inches at 300 MHz, for example. This is where the RCS and deployment concerns arise because of the increased dimensions of the phased array antenna 300.

Figure 10:
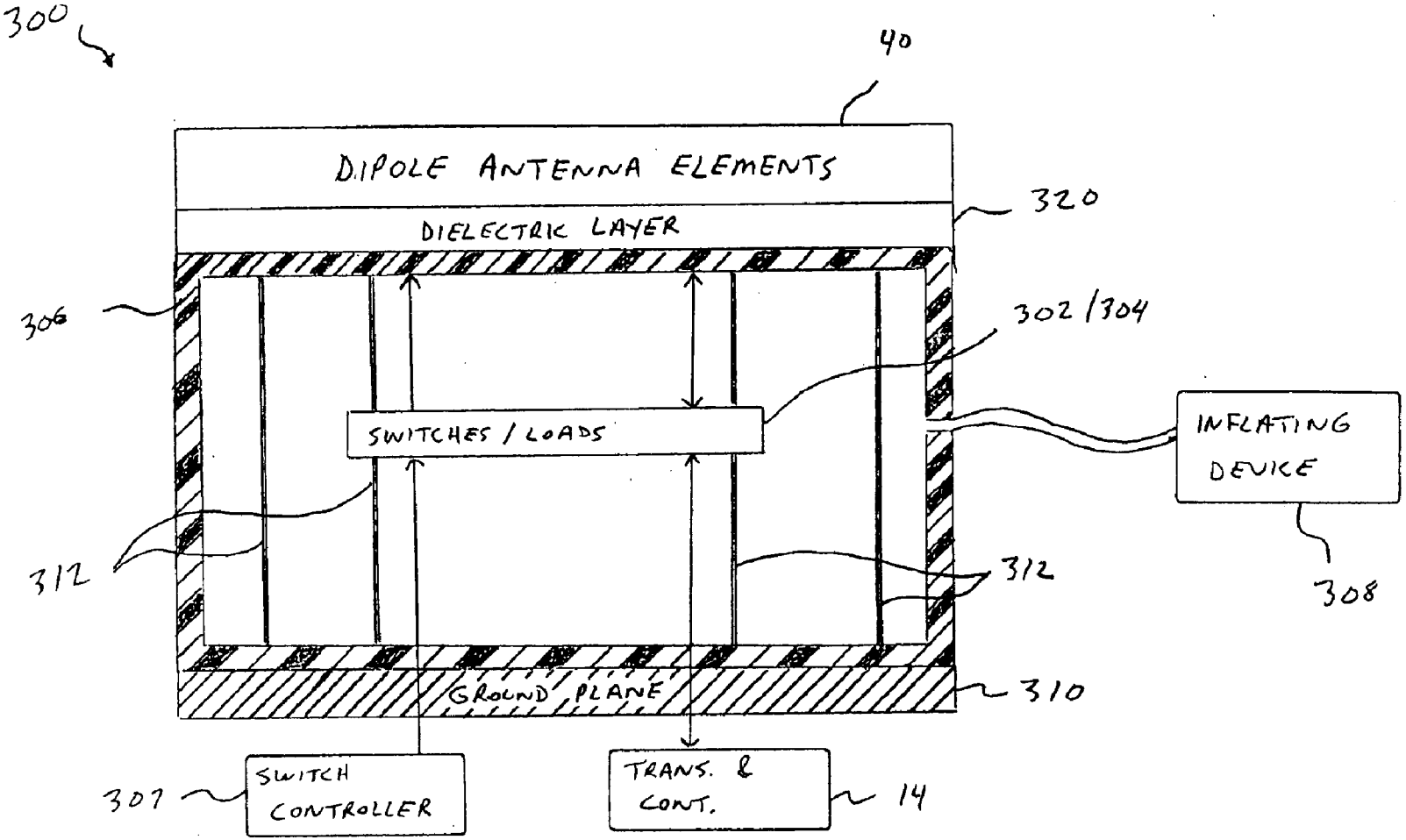
FIG. 10 is a cross-sectional diagram of a phased array antenna that includes the dipole antenna elements of FIG. 9.

Referring now to FIG. 10, the illustrated phased array antenna 300 comprises an inflatable substrate 306 with the array of dipole antenna elements 40 thereon. An inflating device 308 is used to inflate the substrate 306. The inflatable substrate 306 addresses the deployment concerns. When the phased array 300 is not being deployed, or it is being transported, the inflatable substrate 306 is deflated. However, once the phased array antenna 300 is in the field and is ready to be deployed, the inflatable substrate 306 is inflated.

The inflating device 308 may be an air pump, and when inflated, a dielectric layer of air is provided between the array of dipole antenna elements 40 and the ground plane 310. At 300 MHz, the thickness of the inflatable substrate 306 is about 19 inches. Baffles or connections 312 may extend between the two opposing sides of the inflatable substrate 306 so that a uniform thickness is maintained by the substrate when inflated, as would be readily appreciated by those skilled in the art.

The respective switches 302 and loads 304 may also be packaged within the inflatable substrate 306. Consequently, the corresponding feed lines 303 and control lines also pass though the inflatable substrate 306. In alternate embodiments, the respective switches 302 and loads 304 may be packaged external the inflatable substrate 306. When the phased array antenna 300 is to operate as an absorber, the controller 307 switches the switches 302 so that the loads 304 are connected across the medial feed portions 42 of the dipole antenna elements 40 in the array.

An optional dielectric layer 320 may be added between the array of dipole antenna elements 40 and the inflatable substrate 306. The dielectric layer 320 preferably has a higher dielectric constant than the dielectric constant of the inflatable substrate 306 when inflated. The higher dielectric constant helps to improve performance of the phased array antenna 300, particularly when the substrate 306 is inflated with air, which has dielectric constant of 1. The dielectric layer 320 would have a dielectric constant that is greater than 1, and preferably within a range of about 1.2 to 3, for example. The inflatable substrate 306 may be filled with a gas other than air, as would be readily appreciated by those skilled in the art, in which case the dielectric layer 320 may not be required. The inflatable substrate 306 may even be inflated with a curable material.

The inflatable substrate 306 preferably comprises a polymer. However, other materials for maintaining an enclosed flexible substrate may be used, as would be readily appreciated by those skilled in the art. The array of dipole antenna elements 40 may be formed directly on the inflatable substrate 306, or the array may be formed separately and attached to the substrate with an adhesive. Similarly, the ground plane 310 may formed as part of the inflatable substrate 306, or it may be formed separately and is also attached to the substrate with an adhesive.

In an alternative embodiment of the phased array antenna 300, the dipole antenna elements 40 are permanently configured as an absorber by having a resistive element connected to the respective medial feed portions 42, as illustrated in FIGS. 6A and 6B. Such an absorber may be used in an anechoic chamber, or may be placed adjacent an object (e.g., a truck, a tank, etc.) to reduce its RCS, or may be even be placed on top of a building to reduce multipath interference form other signals.

As discussed above, another aspect of the present invention is to further increase the capacitive coupling between adjacent dipole antenna elements 40 using an impedance element 70" or 80'" electrically connected across the spaced apart end portions 46", 46'" of adjacent legs 44" of adjacent dipole antenna elements, as illustrated in FIGS. 5C and 5D. This aspect of the present invention is not limited to the phased array antenna 100 illustrated above. In other words, the impedance elements 70", 80'" may be used on larger size substrate 104, as discussed in U.S. Pat. No. 6,512,487 to Taylor et al., which has been incorporated herein by reference.

For example, the substrate may be twelve inches by eighteen inches. In this example, the number of dipole antenna elements 40 correspond to an array of 43 antenna elements by 65 antenna elements, resulting in an array of 2795 dipole antenna elements.

For this larger size substrate, the array of dipole antenna elements 40 may be arranged at a density in a range of about 100 to 900 per square foot. The array of dipole antenna elements 40 are sized and relatively positioned so that the phased array antenna is operable over a frequency range of about 2 to 30 GHz, and at a scan angle of about ±60 degrees (low scan loss). Such an antenna 100' may also have a 10:1 or greater bandwidth, includes conformal surface mounting (on an aircraft, for example), while being relatively light weight, and easy to manufacture at a low cost. As would be readily appreciated by those skilled in the art, the array of dipole antenna elements 40 in accordance with the present invention may be sized and relatively positioned so that the wideband phased array antenna is operable over other frequency ranges, such as in the MHz range, for example.

Figure 11:
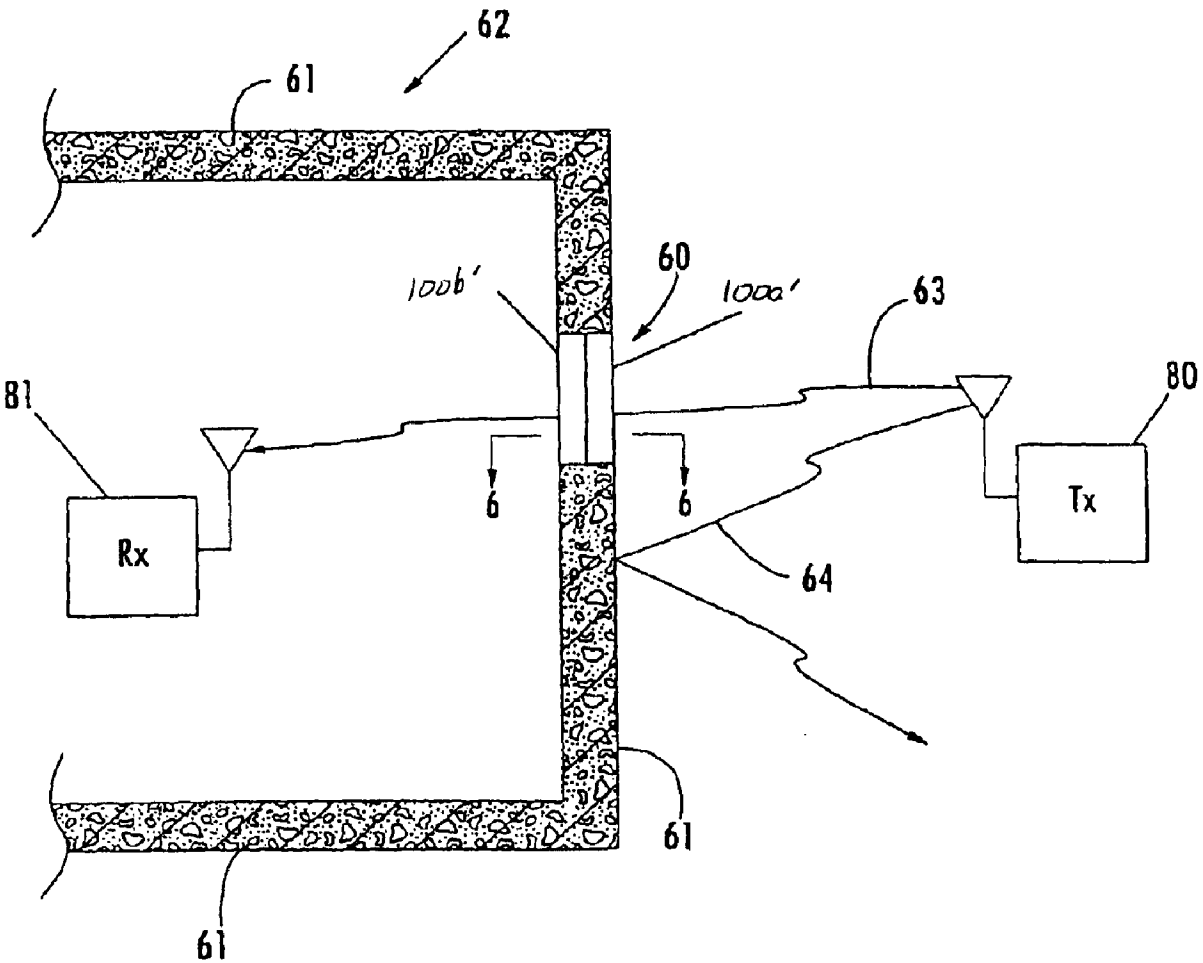
FIG. 11 is top plan view of a building partly in sectional illustrating a feedthrough lens antenna in accordance with the present invention positioned in a wall of the building.

Referring now to FIG. 11, yet another aspect of the present invention is directed to a feedthrough lens antenna 60 that includes this larger size substrate. The feedthrough lens antenna 60 includes first and second phased array antennas 100*a*', 100*b*', which are preferably substantially identical. For a more detailed explanation on the feedthrough lens antenna 60, reference is directed to U.S. Pat. No. 6,417,813 to Durham, which is incorporated herein by reference in its entirety and which is assigned to the current assignee of the present invention.

The feedthrough lens antennas may be used in a variety of applications where it is desired to replicate an electromagnetic (EM) environment within a structure, such as a building 62, over a particular bandwidth. For example, the feedthrough lens antenna 60 may be positioned on a wall 61 of the building 62. The feedthrough lens antenna 60 allows EM signals 63 from a transmitter 80 (e.g., a cellular telephone base station) to be replicated on the interior of the building 62 and received by a receiver 81 (e.g., a cellular telephone). Otherwise, a similar signal 64 may be partially or completely reflected by the walls 61.

The first and second phased array antennas 100*a*', 10*b*' are connected by a coupling structure 66 in a back-to-back relation. The first and second phased array antennas 100*a*', 100*b* are substantially similar to the antenna 100 described above, except with the edge elements 40*b* preferably removed.

In addition, other features relating to the phased array antennas are disclosed in copending patent applications filed concurrently herewith and assigned to the assignee of the present invention and are entitled CAVITY MOUNT FOR PHASED ARRAY ANTENNA WITH EDGE ELEMENTS AND ASSOCIATED METHODS, Ser. No. 10/634,032; PHASED ARRAY ANTENNA ABSORBER AND ASSOCIATED METHODS, Ser. No. 10/633,929; METHOD FOR DEPLOYING A PHASED ARRAY ANTENNA ABSORBER, Ser. No. 10/634,033; and PHASED ARRAY ANTENNA WITH DISCRETE CAPACITIVE COUPLING AND ASSOCIATED METHODS, Ser. No. 10/634,036, the entire disclosures of which are incorporated herein in their entirety by reference.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A phased array antenna comprising:

a substrate having a first surface, and a second surface adjacent thereto and defining an edge therebetween; and a plurality of dipole antenna elements on the first surface and at least a portion of at least one dipole antenna element on the second surface, each dipole antenna element comprising a medial feed portion and a pair of legs extending outwardly therefrom, and adjacent legs of adjacent dipole antenna elements including respective spaced apart end portions having predetermined shapes and relative positioning for providing increased capacitive coupling between the adjacent dipole antenna elements.

2. A phased array antenna according to claim 1 further comprising a load connected to the medial feed portion of said at least one dipole antenna element having at least a portion thereof on the second surface.

3. A phased array antenna according to claim 2 wherein said load comprises a resistive load.

4. A phased array antenna according to claim 1 further comprising respective feed lines connected to said plurality of dipole antenna elements on the first surface.

5. A phased array antenna according to claim 1 further comprising a ground plane adjacent said plurality of dipole antenna elements; and wherein said at least one dipole antenna element having at least a portion thereof on the second surface is connected to said ground plane.

6. A phased array antenna according to claim 5 wherein the phased array antenna has a desired frequency range; and wherein said ground plane is spaced from the first surface less than about one-half a wavelength of a highest desired frequency.

7. A phased array antenna according to claim 1 wherein the second surface is orthogonal to the first surface.

8. A phased array antenna according to claim 1 wherein said substrate has a generally rectangular shape having a top surface defining the first surface, and first and second pairs of opposing side surfaces defining the second surface.

9. A phased array antenna according to claim 1 wherein each leg comprises:

an elongated body portion; and an enlarged width end portion connected to an end of the elongated body portion.

10. A phased array antenna according to claim 1 wherein the spaced apart end portions in adjacent legs comprise interdigitated portions.

11. A phased array antenna according to claim 10 wherein each leg comprises:

an elongated body portion;

an enlarged width end portion connected to an end of the elongated body portion; and a plurality of fingers extending outwardly from said enlarged width end portion.

12. A phased array antenna according to claim 1 wherein the phased array antenna has a desired frequency range; and wherein the spacing between the end portions of adjacent legs is less than about one-half a wavelength of a highest desired frequency.

13. A phased array antenna according to claim 1 wherein said plurality of dipole antenna elements comprises first and second sets of orthogonal dipole antenna elements to provide dual polarization.

14. A phased array antenna according to claim 1 wherein each dipole antenna element comprises a printed conductive layer.

15. A phased array antenna according to claim 1 wherein said plurality of dipole antenna elements are sized and relatively positioned so that the phased array antenna is operable over a frequency range of about 2 to 30 GHz.

16. A phased array antenna according to claim 1 wherein said plurality of dipole antenna elements are sized and relatively positioned so that the phased array antenna is operable over a scan angle of about 60 degrees.

17. A phased array antenna according to claim 1 further comprising a respective impedance element electrically connected between the spaced apart end portions of adjacent legs of adjacent dipole antenna elements for further increasing the capacitive coupling therebetween.

18. A phased array antenna according to claim 1 further comprising a respective printed impedance element adjacent the spaced apart end portions of adjacent legs of adjacent dipole antenna elements for further increasing the increased capacitive coupling therebetween.

19. A phased array antenna comprising:

a substrate having a first surface, and at least a pair of second surfaces adjacent thereto and defining respective edges therebetween;

a plurality of dipole antenna elements on the first surface and the second surfaces, each dipole antenna element comprising a medial feed portion and a pair of legs extending outwardly therefrom; and a respective load connected to the medial feed portion of said plurality of dipole antenna elements on the second surfaces.

20. A phased array antenna according to claim 19 wherein said load comprises a resistive load.

21. A phased array antenna according to claim 19 further comprising a ground plane adjacent said plurality of dipole antenna elements; and wherein each dipole antenna element comprising a load connected to the medial feed portion thereof is also connected to said ground plane.

22. A phased array antenna according to claim 21 wherein the phased array antenna has a desired frequency range; and wherein said ground plane is spaced from the first surface of said substrate less than about one-half a wavelength of a highest desired frequency.

23. A phased array antenna according to claim 19 wherein each leg comprises:

an elongated body portion; and an enlarged width end portion connected to an end of the elongated body portion.

24. A phased array antenna according to claim 19 wherein adjacent legs of adjacent dipole antenna elements on the first and second surfaces include respective spaced apart end portions having predetermined shapes and relative positioning for providing increased capacitive coupling between the adjacent dipole antenna elements.

25. A phased array antenna according to claim 24 wherein the spaced apart end portions in adjacent legs comprise interdigitated portions.

26. A phased array antenna according to claim 22 further comprising a respective impedance element electrically connected between the spaced apart end portions of adjacent legs of adjacent dipole antenna elements for further increasing the capacitive coupling therebetween.

27. A phased array antenna according to claim 22 further comprising a respective printed impedance element adjacent the spaced apart end portions of adjacent legs of adjacent dipole antenna elements for further increasing the increased capacitive coupling therebetween.

28. A method of making a phased array antenna on a substrate having a first surface, and a second surface adjacent thereto and defining an edge therebetween, the method comprising:

forming a plurality of dipole antenna elements on the first surface and at least a portion of at least one dipole antenna element on the second surface;

each dipole antenna element comprising a medial feed portion and a pair of legs extending outwardly therefrom, and adjacent legs of adjacent dipole antenna elements on the first and second surfaces including respective spaced apart end portions having predetermined shapes and relative positioning for providing increased capacitive coupling between the adjacent dipole antenna elements.

29. A method according to claim 28 further comprising connecting a load to the medial portion of the at least one dipole antenna element having at least a portion thereof on the second surface.

30. A method according to claim 29 wherein the load comprises a resistive load.

31. A method according to claim 29 further comprising:

forming a ground plane adjacent the plurality of dipole antenna elements; and connecting the at least one dipole antenna element having at least a portion thereof on the second surface to the ground plane.

32. A method according to claim 31 wherein the phased array antenna has a desired frequency range; and wherein the ground plane is spaced from the first surface less than about one-half a wavelength of a highest desired frequency.

33. A method according to claim 31 wherein the substrate has a generally rectangular shape having a top surface defining the first surface, and first and second pairs of opposing side surfaces defining the second surface.

34. A method according to claim 28 wherein forming the plurality of dipole antenna elements comprises forming each leg with an elongated body portion, and an enlarged width end portion connected to an end of the elongated body portion.

35. A method according to claim 28 wherein shaping and positioning respective spaced apart end portions comprises forming interdigitated portions.

36. A method according to claim 28 wherein forming the plurality of dipole antenna elements comprises forming first and second sets of orthogonal dipole antenna elements to provide dual polarization.

37. A method according to claim 28 further comprising electrically connecting a respective impedance element between the spaced apart end portions of adjacent legs of adjacent dipole antenna elements for further increasing the capacitive coupling therebetween.

38. A method according to claim 28 further comprising positioning a respective printed impedance element adjacent the spaced apart end portions of adjacent legs of adjacent dipole antenna elements for further increasing the increased capacitive coupling therebetween.

* * * * *

UNITED STATES PATENT AND TRADEMARK OFFICE

CERTIFICATE OF CORRECTION

PATENT NO. : 6,876,336 B2
APPLICATION NO. : 10/633930
DATED : April 5, 2005
INVENTOR(S) : Croswell et al.

It is certified that error appears in the above-identified patent and that said Letters Patent is hereby corrected as shown below:

| | |
|---|---|
| Column 4, Line 33 | Insert -- a -- after "is" |
| Column 10, Line 55 | Delete: "though"<br>Insert -- through -- |
| Column 11, Line 2 | Insert -- a -- after "has" |
| Column 11, Line 17 | Insert -- be -- after "may" |
| Column 11, Lines 26-27 | Delete: "may be even be"<br>Insert -- may even be -- |
| Column 11, Line 28 | Delete: "form"<br>Insert -- from -- |

Signed and Sealed this

Twenty-first Day of October, 2008

JON W. DUDAS
*Director of the United States Patent and Trademark Office*